US005611595A

United States Patent [19]

Gatehouse

[11] Patent Number: 5,611,595

[45] Date of Patent: Mar. 18, 1997

[54] FURNITURE COVER

[75] Inventor: Janet L. Gatehouse, Minnetrista, Minn.

[73] Assignee: Fingerhut Corporation, Minnetonka, Minn.

[21] Appl. No.: 499,662

[22] Filed: Jul. 7, 1995

[51] Int. Cl.[6] ..... A47C 31/00

[52] U.S. Cl. ..... 297/228.12; 297/229; 150/158

[58] Field of Search ..... 297/228, 228.12, 297/229, 219.1; 5/482, 496, 498; 150/157, 158; 383/4

[56] References Cited

U.S. PATENT DOCUMENTS

| | | | |
|---|---|---|---|
| 663,306 | 12/1900 | Tompkins . | |
| 794,145 | 7/1905 | Ellington et al. | 297/229 |
| 1,011,114 | 12/1911 | Button | 383/4 |
| 1,016,374 | 2/1912 | Spence | 388/4 |
| 1,326,746 | 12/1919 | Kunath . | |
| 1,871,101 | 8/1932 | Waltz . | |
| 2,434,784 | 1/1948 | Bardin . | |
| 2,551,214 | 5/1951 | Lenz | 297/228 |
| 2,797,743 | 7/1957 | Rodtz | 297/229 |
| 3,116,953 | 1/1964 | Sugarman | 297/228 |
| 4,396,227 | 8/1983 | Neilson | 297/228.12 |
| 4,789,247 | 12/1988 | Schnoor | 383/4 |
| 4,824,168 | 4/1989 | Makoski | 297/229 |
| 4,848,828 | 7/1989 | Hunt . | |
| 5,333,921 | 8/1994 | Dinsmoor, III | 297/219.1 |
| 5,368,912 | 11/1994 | Reaves . | |
| 5,429,541 | 7/1995 | Landon | 383/4 |
| 5,518,313 | 5/1996 | McAdam | 383/4 |

FOREIGN PATENT DOCUMENTS

| | | | |
|---|---|---|---|
| 0450579 | 8/1948 | Canada | 297/228 |
| 1143275 | 2/1969 | United Kingdom | 297/278.12 |

OTHER PUBLICATIONS

Regency Home Fashions, Inc. instruction sheet for Ruffled Furniture Throw Covers, one page.

Fingerhut catalog entitled, *Linens Linens Linens,* two cover pages, and pp. 41, 42 and 60, dated Nov. 2, 1994.

Fingerhut catalog entitled, *Gift guide,* two cover pages, and pp. 19 and 80, dated Fall, 1994.

Spiegel catalog entitled, *Great Buys,* two cover pages, and pp. 188, 189, 194, 196, 203 and 205, dated Spring, 1994.

Spiegel catalog entitled, *Style For Life,* two pages, dated Spring/Summer, 1995.

Domestications catalog entitled, *Domestications,* two cover pages, and pp. 46–49, dated 1994.

J.C. Penney catalog, front cover page, and pp. 1151–1161, dated Fall & Winter 1994.

Anversa North America catalog entitled, *The Contour Slipcover,* 4 pages.

Pottery Barn catalog pp. 1–23 and back cover page, dated Jan., 1995.

*Primary Examiner*—Peter M. Cuomo
*Assistant Examiner*—Anthony D. Barfield
*Attorney, Agent, or Firm*—Merchant, Gould, Smith, Edell, Welter & Schmidt P.A.

[57] ABSTRACT

A furniture cover including a sheet of material having a top side and a bottom side and being sized to cover a piece of furniture. The sheet includes a plurality of hole pairs with each hole pair including a first hole spaced from a corresponding second hole. A plurality of ties are looped through the hole pairs. Each of the ties passes through one of the first holes, extends across the bottom side of the sheet between the first hole and the corresponding second hole, and passes through the second hole. When the furniture cover is placed over a piece of furniture, the hole pairs are located at selected positions along the front and back of the piece of furniture such that when the ties are tied, the sheet is cinched into a bunched configuration. In the bunched configuration, the sheet conforms to the shape of the piece of furniture and has a fitted appearance.

3 Claims, 2 Drawing Sheets

FURNITURE COVER

FIELD OF THE INVENTION

The present invention relates to covers and methods for covering stuffed furniture.

BACKGROUND OF THE INVENTION

A variety of products exist for refurbishing stuffed furniture which has become worn or outdated. For example, furniture may be refurbished by reupholstering the furniture. However, this option is often prohibitively expensive. Another refurbishing technique is to employ a fitted cover which is precisely tailored to the exact dimensions of the piece of furniture desired to be covered. However, this option is also often prohibitively expensive.

Another technique employed to refurbish furniture is to place a drop cloth over the furniture. However, drop cloths rarely conform to the shape of the piece of furniture being covered and are typically free to move when a person sits on the piece of furniture. This results in an unfitted, baggy and non-tailored appearance which is aesthetically unappealing. The appearance of a conventional drop cloth may be improved by employing pins to conform the drop cloth to the shape of the piece of furniture. However, employing pins is time consuming and difficult to achieve an aesthetically pleasing result.

SUMMARY OF THE INVENTION

The present invention relates to a furniture cover including a sheet of material having a top side and a bottom side and being sized to cover a piece of stuffed furniture. The sheet includes a plurality of hole pairs, with each hole pair including a first hole spaced from a corresponding second hole. A plurality of ties are looped through the hole pairs. Each of the ties passes through one of the first holes, extends across the bottom side of the sheet between the first hole and the corresponding second hole, and passes through the second hole. When the furniture cover is placed over a piece of furniture, the hole pairs are located at selected positions along the front and back of the piece of furniture such that when the ties are tied, the sheet is cinched into a bunched configuration. In the bunched configuration, the sheet conforms to the shape of the piece of furniture and has a fitted appearance.

The present invention also includes a method of covering a piece of stuffed furniture. The method includes placing a sheet of material over the stuffed furniture. The sheet is then bunched and cinched in selected locations by individually pulling a plurality of ties which are looped through holes in the sheet. The ties are tied to maintain the bunched state of the sheet.

The present invention provides an improved furniture cover which is inexpensive, easy to fit on a piece of furniture and has an aesthetically pleasing appearance.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE INVENTION

Reference will now be made in detail to exemplary embodiments of the present invention which are illustrated in the accompanying drawings. Wherever possible, the same reference numbers will be used throughout the drawings to refer to the same or like parts.

Figure 1:
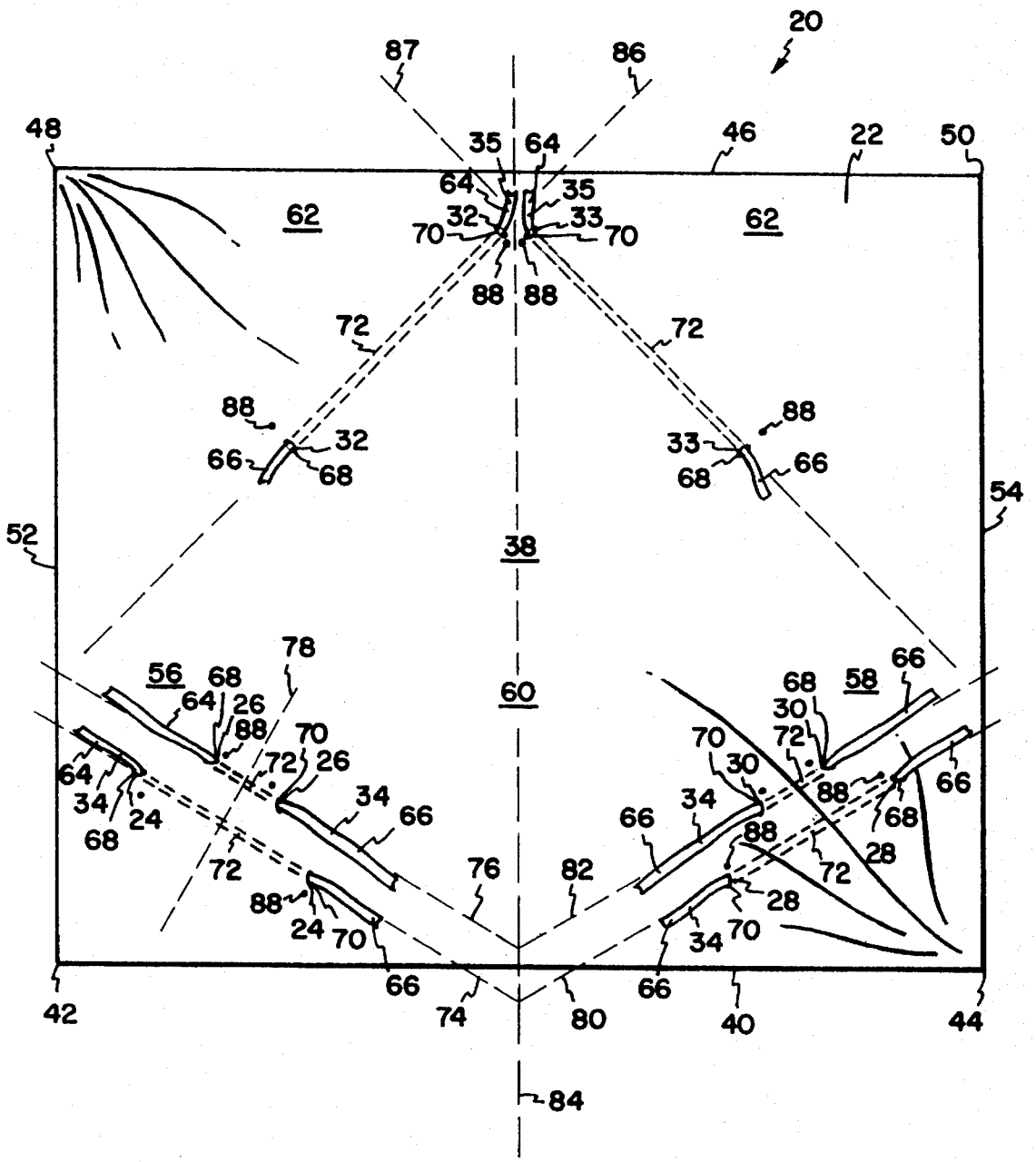
FIG. 1 is a plan view of a furniture cover in accordance with the principles of the present invention.

FIG. 1 shows a furniture cover 20 in accordance with the principles of the present invention. The furniture cover 20 preferably includes a sheet 22 which is sized to cover a piece of furniture. The sheet 22 includes a first hole pair 24, a second hole pair 26, a third hole pair 28, a fourth hole pair 30, a fifth hole pair 32, and a sixth hole pair 33. The hole pairs 24, 26, 28, 30, 32, 33 are oriented on the sheet 22 such that when the sheet 22 is positioned on a piece of furniture, the first, second, third and fourth hole pairs 24, 26, 28, 30 are located at the front of the piece of furniture and the fifth and sixth hole pairs 32, 33 are located at the back of the piece of furniture.

The furniture cover 20 also preferably includes front ties 34 which are each looped through one of the first, second, third, and fourth hole pairs 24, 26, 28, 30, and back ties 35 which are looped through the fifth and sixth hole pairs 32, 33. The hole pairs 24, 26, 28, 30, 32, 33 are located at selected positions such that when the ties 34, 35 passing through the hole pairs 24, 26, 28, 30, 32, 33 are cinched and tied, the sheet 22 bunches at selected locations. The bunching of the sheet 22 at selected locations causes the sheet 22 to closely conform to the shape of the piece of furniture thereby creating an attractive fitted appearance. The ties 34, 35 allow the sheet 22 with no initial predefined shape to have a defined shape when the ties 34, 35 are tied with the sheet 22 in place over the furniture. The ties 34, 35 also allow for adjustability of the fit, and for variations in sizes and amount of stuffing in similarly sized furniture. Also, the ties 34, 35 will not pop out or allow the cover 20 to become loose as in the case of a cover merely tucked or held in place by pins.

The sheet 22 is preferably thin and flexible and is preferably made of conventional fabric materials such as wool, cotton, polyester or nylon. However, the sheet 22 may also be made of other similarly flexible and thin materials such as plastic.

The sheet 22 has a bottom side (not shown) which typically faces the piece of furniture which is being covered, and a top side 38 which typically faces away from the piece of furniture which is being covered. The sheet 22 is preferably rectangular shaped and preferably includes a front edge 40 extending between first and second front corners 42 and 44 and a back edge 46 extending between first and second back corners 48 and 50. The sheet 22 also preferably includes substantially parallel first and second side edges 52 and 54 which extend respectively between the first front corner 42 and the first back corner 48 and between the second front corner 44 and the second back corner 50. When the sheet 22 is fitted over a piece of furniture, the front edge 40 preferably aligns along the front of the piece of furniture, the back edge 46 preferably aligns along the back of the piece of furniture, and the first and second side edges 52 and 54 preferably align along the sides of the piece of furniture.

The sheet 22 also preferably includes a first arm rest region 56 located generally proximate to the first front corner 42 and a second arm rest region 58 located generally proximate to the second front corner 44. When the sheet 22 is placed over a piece of furniture, the first and second arm rest regions 56 and 58 preferably cover the arm rests of the piece of furniture. A central region 60 of the sheet 22 is located between the first and second arm rest regions 56 and 58. The central region 60 covers the center portion of a piece of furniture which typically includes a back rest and a section for supporting one or more cushions. The sheet 22 also preferably includes a back region 62 located adjacent to the back edge 46 of the sheet 22. When the sheet 22 is placed over a piece of furniture, the back region 62 preferably covers the back of the piece of furniture.

The ties 34, 35 of the furniture cover 20 are preferably made of the same material employed to fabricate the sheet 22 of the furniture cover 20. The ties 34, 35 are typically elongated strips of fabric material each having a first end 64 and a second end 66. Preferably, the ties 34, 35 all have equal length to facilitate ease of use by consumers who may have to assemble the furniture cover 20 at home. The lengths of the ties 34, 35 could vary if desired depending upon the spacing of their corresponding hole pairs 24, 26, 28, 30, 32, 33.

Figure 2:
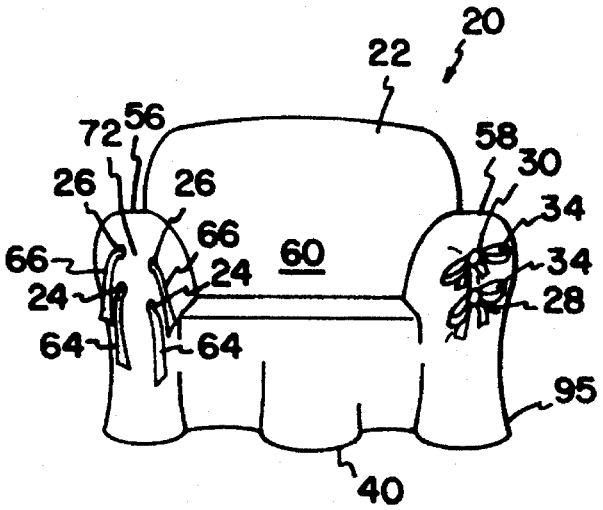
FIG. 2 is a front view of a piece of furniture which is covered by furniture cover of FIG. 1.
Figure 3:
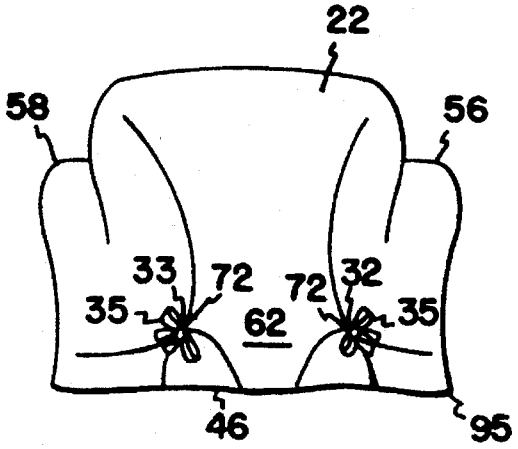
FIG. 3 is a back view of the piece of furniture of FIG. 2 which is covered by the furniture cover of FIG. 1.
Figure 4:
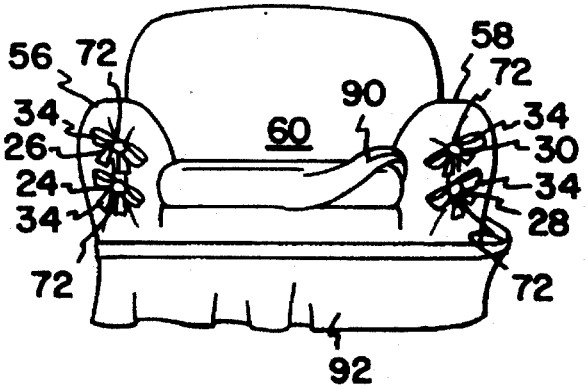
FIG. 4 is a front view of the piece of furniture of FIGS. 2 and 3 including a throw cushion cover and a skirt.

It will be appreciated that each of the hole pairs 24, 26, 28, 30, 32, 33 includes a first hole 68 and a second hole 70 with a material portion 72 located between the holes 68 and 70 such that the holes 68 and 70 are spaced apart. It is preferred for the first and second holes 68 and 70 of the hole pairs 24, 26, 28, 30, 32, 33 to be conventional button holes. Each of the ties 34, 35 pass through one of the first holes 68 extend across the bottom side (not shown) of the sheet 22 between the first hole 68 and the corresponding second hole 70, and pass through the second hole 70. The first ends 64 of the ties 34, 35 pass through the first holes 68 and extend along the top side 38 of the sheet 22. Similarly, the second ends 66 of the ties 34 pass through the second holes 70 and extend along the top side 38 of the sheet 22. By tying the first and second ends 64 and 66 of the ties 34 together, the material portions 72 located between the first and second holes 68 and 70 are cinched together thereby bunching the sheet 22, such as shown in FIG. 2–4.

The first hole pair 24 and the second hole pair 28 are preferably located within the first arm rest region 56 of the sheet 22 generally proximate to the first front corner 42. The first and second holes 68 and 70 of the first hole pair 24 are preferably aligned along a first line 74 which forms oblique angles with respect to the first side edge 52 and the front edge 40 of the sheet 22.

The first and second holes 68 and 70 of the second hole pair 26 are aligned along a second line 76 which is preferably parallel to and located above the first line 74. The material portions 72 between the first and second holes 68 and 70 of the first hole pair 24 and the first and second holes 68 and 70 of the second hole pair 26 are preferably aligned such that they are bisected by a third line 78 which extends perpendicularly between the first line 74 and the second line 76. The material portion 72 between the first and second holes 68 and 70 of the first hole pair 24 is preferably larger than the material portion 72 between the first and second holes 68 and 70 of the second hole pair 26.

The third hole pair 28 and the fourth hole pair 30 are preferably located in the second arm rest region 58 of the sheet 22 generally proximate to the second front corner 44. The first and second holes 68 and 70 of the third hole pair 28 are preferably aligned along a third line 80 which forms oblique angles with respect to the front edge 40 and the second side 54 of the sheet 22. Similarly, the first and second holes 68 and 70 of the fourth hole pair 30 are aligned along a fourth line 82 which is preferably located above and substantially parallel to the third line 80. It is preferred for the third and fourth hole pairs 28 and 30 and the first and second hole pairs 24 and 26 to be symmetrically arranged about an symmetry axis 84 which bisects the front and back edges 40 and 48 of the sheet 22.

The fifth and sixth hole pairs 32, 33 are preferably located in the back region 62 of the sheet 22. The first and second holes 68 and 70 of the fifth hole pair 32 are preferably located generally proximate to the first back corner 48 and are preferably aligned along a fifth line 86 which forms oblique angles with respect to the first side edge 52 and the back edge 46. The first and second holes 68 and 70 of the sixth hole pair 33 are preferably located generally proximate to the second back corner 50 and are preferably aligned along a sixth line 87 which forms oblique angles with respect to the second side edge 54 and the back edge 46. The fifth hole pair 32 and the sixth hole pair are preferably symmetrical about the symmetry axis 84.

It will be appreciated that a variety of alternative hole pair arrangements are included within the scope of the present invention. For example, more or less than two hole pairs may be located in each of the first and second arm rest regions 56, 58 of the sheet 22. It may be desireable to include a single first hole pair adjacent to the first arm rest region 56 and a single second hole pair adjacent to the second arm rest region 58. Additionally more or less than two hole pairs may be located in the back region 62 of the sheet 22. It may be desireable to have a single hole pair located adjacent to the center of the back of the piece of furniture. Furthermore, the arrangement of the holes may be varied without departing from the scope of the present invention.

It will be appreciated that furniture covers of the present invention may have different sizes in order to properly cover furniture of different sizes. For example, a furniture cover sheet sized for a chair is approximately 90 inches by 110 inches, a furniture cover sheet sized for a loveseat is approximately 90 inches by 130 inches, a furniture cover sheet sized for a small sofa is approximately 90 inches by 150 inches and a furniture cover sheet sized for a large sofa is approximately 90 inches by 180 inches. Other sizes and shapes are possible if desired.

The preferred hole location dimensions for the furniture cover 20 illustrated in FIG. 1, which is designed for a chair and preferably has dimensions equal to 90 inches by 110 inches, are described in the following paragraph. It will be appreciated that the dimensions described in the following paragraph are strictly illustrative and are not to be construed as a limitation upon the invention.

The first hole 68 of the first hole pair 24 is preferably perpendicularly offset approximately 9 inches from the first side edge 52 and approximately 21.5 inches from the front edge 40. The second hole 70 of the first hole pair 24 is preferably perpendicularly offset approximately 29.5 inches from the first side edge 52 and approximately 9 inches from the front edge 40. When the first hole pair 24 is aligned as described above, the first line 74 substantially defines a 30—60—90 triangle with respect to the front edge 40 and the first side edge 52.

The first hole 68 of the second hole pair 26 is preferably perpendicularly offset approximately 17 inches from the first side edge 52 and approximately 22.5 inches from the front edge 40. The second hole 70 of the second hole pair 26 is preferably perpendicularly offset approximately 26 inches from the first side edge 52 and approximately 17 inches from the front edge 40. When the second hole pair 26 is aligned as described above, the second line 76 is located above and generally parallel to the first line 74.

The third and fourth hole pairs 28 and 30 and the first and second hole pairs 24 and 26 are preferably symmetric about the symmetry axis 84. Therefore, the dimensions relating to the first and second hole pairs 24 and 26 relative to the first side edge 52 and the front edge 40 are equal to the dimensions of the third and fourth hole pairs 28 and 30 relative to the second side edge 54 and the front edge 40. Additionally, the third and fourth lines 80, 82 substantially define 30—60—90 triangles with respect to the front edge 40 and the second side edge 54.

The first hole 68 of the fifth hole pair 32 is preferably perpendicularly offset approximately 28 inches from the first side edge 52 and approximately 32 inches from the back edge 46. The second hole 70 of the fifth hole pair 32 is preferably perpendicularly offset approximately 53 inches from the first side edge 52 and approximately 6 inches from the back edge 46. When the fifth hole pair 32 is aligned as described above, the fifth line 74 generally defines an isosceles triangle with respect to the back edge 46 and the first side edge 52. The sixth hole pair 33 is symmetrical to the fifth hole pair 32 about the symmetry axis 84.

It will also be appreciated that the first, second, third, fourth, fifth and sixth hole pairs 24, 26, 28, 30, 32, 33 may be marked with indicia 88 such as sewn or adhesive labels having coded numbers, symbols, letters or colors. The indicia 88 assist users of the furniture cover 20 in looping the ties 34, 35 through the proper hole pairs 24, 26, 28, 30, 32, 33 thereby facilitating fitting the furniture cover 20 over a piece of furniture.

It will be appreciated that it may be desireable to sell the furniture cover 20 in a kit which includes the sheet 22 having the hole pairs 24, 26, 28, 30, 32, 33. The hole pairs 24, 26, 28, 30, 32, 33 are preferably marked with the indicia 88 for facilitating assembly of the cover 20. The kit preferably also includes the front and back ties 34 and 35 which may be preinserted through the hole pairs 24, 26, 28, 30, 32, 33 or may be loosely included with the sheet 22.

A method for covering a piece of furniture 95 with the furniture cover 20 is shown in FIGS. 2–4. The piece of furniture 95 is a stuffed chair having any one of a typical conventional shape and size. However, before covering the piece of furniture 95, it is preferred to measure the piece of furniture 95 to determine an appropriate furniture cover size. In this regard, the first step is to remove any cushions from the central portion of the piece of furniture 95. Then, using a flexible measuring tape, start at the floor and measure up and over the first arm rest to the central portion of the furniture, across the width of the central portion, up and over the second arm rest, and down to the floor adjacent the second arm rest. An additional ten inches should be added to the length of the furniture cover 20 for the purpose of facilitating tucking beneath the piece of furniture 95.

Once the furniture cover 20 of the appropriate size has been acquired, any cushions are removed from the piece of furniture 95 and the sheet 22 is draped and centered over the piece of furniture 95 as shown in FIG. 2. As centered on the piece of furniture 95, the first arm rest region 56 of the sheet 22 is draped over the first arm rest of the piece of furniture 95, the central region 60 of the sheet 22 is spread along the central region of the piece of furniture 95, the second arm rest region 58 of the sheet 22 is draped over the second arm of the piece of furniture 95 and the back region 62 of the sheet 22 is aligned along the back of the piece of furniture 95.

In the centered arrangement described above, the first and second hole pairs 24 and 26 are aligned along the front of the first arm rest of the piece of furniture 95, the third and fourth hole pairs 28 and 30 are aligned along the front of the second arm rest of the piece of furniture 95 and the fifth and sixth hole pairs 32 and 33 are positioned at the back of the piece of furniture.

Once the furniture cover 20 is centered on the piece of furniture 95, the front ties 34 are looped through the first, second, third, and fourth hole pairs 24, 26, 28, 30 (as illustrated by the first and second hole pairs 24 and 26 shown in FIG. 2). Alternatively, the ties 34 can be positioned in the hole pairs 24, 26, 28, 30 before placement of the furniture cover 20 over the piece of furniture 95. The ends 64 and 66 of the front ties 34 are then preferably tied in a bow such that the material portions 72 located between the first and second holes 68 and 70 of the first, second, third, and fourth hole pairs 24, 26, 28, 30 are bunched into a bunched configuration (as illustrated by the third and fourth hole pairs 28 and 30 shown in FIG. 2). As bunched, the first and second arm rest regions 56 and 58 are conformed generally to the shape of the first and second arm rests of the piece of furniture 95. It will be appreciated that the first and second ends 64 and 66 of the ties 34 may be tied in a knot or the bows may be turned into one of the first or second holes 68 and 70 in order to create a more tailored look.

Next, excess sheet 22 material is tucked beneath the sides of the piece of furniture 95 and the back ties 35 are looped through the first and second holes 68 and 70 of the fifth and sixth hole pairs 32 and 33. Alternatively, the back ties 35 can be positioned in the hole pairs 32, 33 before placement of the furniture cover 20 over the piece of furniture 95. The ends 64 and 66 of the back ties 35 are then tied together in a bow or a knot, as shown in FIG. 3, such that the material portions 72 located between the first and second holes 68 and 70 of the fifth and sixth hole pairs 32 and 33 are bunched together causing the sheet 22 to cinch about the front, sides and back of the piece of furniture 95. As cinched, sheet 22 has a fitted and aesthetically pleasing appearance which conforms to the contour of the piece of furniture 95.

Next, as shown in FIG. 4, the cushion or cushions of the piece of furniture 95 are fitted within a furniture throw cushion cover 90 having an elastic band for maintaining the cover 90 on the cushion. Loose and excess fabric is tucked under the cushion to improve the appearance of the furniture cover 20.

Finally, as also shown in FIG. 4, a furniture throw skirt 92 having an upper elastic band is slipped over the piece of furniture 95 and adjusted around the bottom of the piece of furniture 95. Any remaining excess material is tucked under the piece of furniture to improve the aesthetic appearance.

It will be appreciated that alternative embodiments of the present invention will be fitted on a piece of furniture by employing similar bunching and cinching techniques as described above. It will further be appreciated that the method described above is strictly illustrative, and that variations may be made in the sequence and number of the steps without departing from the scope of the present invention.

With regard to the foregoing description, it is to be understood that changes may be made in detail, especially in matters of construction materials employed and the shape, size and arrangement of the parts without departing from the scope of the present invention. It is intended that the specification and depicted embodiment be considered exemplary only, with a true scope and spirit of the invention being indicated by the broad meaning of the following claims.

What is claimed is:

1. A furniture cover comprising:

a generally rectangular sheet of flexible material sized to cover a piece of stuffed furniture;

the sheet having a top side and a bottom side and including first and second front corners and first and second back corners;

the sheet further including first and second hole pairs having holes extending from the top side to the bottom side and positioned generally proximate to the first front corner, third and fourth hole pairs having holes extending from the top side to the bottom side and positioned generally proximate to the second front corner, a fifth hole pair having holes extending from the top side to the bottom side and positioned generally proximate to the first back corner, and a sixth hole pair having holes extending from the top side to the bottom side and positioned generally proximate to the second back corner;

wherein the first hole pair is positioned below the second hole pair, and the third hole pair is positioned below the fourth hole pair;

wherein the sheet includes a front edge extending between the first and second front corners, a back edge extending between the first and second back corners, a first side edge extending between the first front corner and the first back corner, and a second side edge extending between the second front corner and the second back corner;

wherein the first hole pair is aligned along a first line forming oblique angle with respect to the first side edge and the front edge, the second hole pair is aligned along a second line generally parallel to the first line, the third hole pair is aligned along a third line forming oblique angles with respect to the second side edge and the front edge, and the fourth hole pair is aligned along a fourth line generally parallel to the third line; and a plurality of ties for looping through the hole pairs.

2. The furniture cover of claim 1, wherein the first, second, third, and fourth hole pairs each include first and second holes, wherein the first and second holes of the first hole pair are spaced farther apart than the first and second holes of the second hole pair, and the first and second holes of the third hole pair are spaced farther apart than the first and second holes of the fourth hole pair.

3. The furniture cover of claim 2, wherein the first and second hole pairs and the third and fourth hole pairs are symmetrical about a central symmetry axis.

* * * * *